US010190315B2

(12) United States Patent
Moore

(10) Patent No.: US 10,190,315 B2
(45) Date of Patent: Jan. 29, 2019

(54) REBAR CONSTRUCTION AND TRANSPORTATION SYSTEM

(71) Applicant: Dennis Moore, Villages, FL (US)

(72) Inventor: Dennis Moore, Villages, FL (US)

( * ) Notice: Subject to any disclaimer, the term of this patent is extended or adjusted under 35 U.S.C. 154(b) by 133 days.

(21) Appl. No.: 15/231,990

(22) Filed: Aug. 9, 2016

(65) Prior Publication Data

US 2018/0044919 A1 Feb. 15, 2018

(51) Int. Cl.

| | |
|---|---|
| ***E04C 5/16*** | (2006.01) |
| ***E04B 1/41*** | (2006.01) |
| ***B25B 11/02*** | (2006.01) |
| ***B25B 5/08*** | (2006.01) |

(52) U.S. Cl.

CPC ..... *E04C 5/162* (2013.01); *B25B 5/08* (2013.01); *B25B 11/02* (2013.01); *E04B 1/4142* (2013.01); *E04C 5/163* (2013.01)

(58) Field of Classification Search

CPC ..... B25B 11/02; E04B 1/4142; E04B 1/0604–1/0618; E04C 5/16; E04C 5/162; E04C 5/163; E04G 21/142

See application file for complete search history.

(56) References Cited

U.S. PATENT DOCUMENTS 1,318,405 A * 10/1919 Perrott ..... E04C 5/18 52/677
1,706,801 A 3/1929 Merrill
1,911,957 A * 5/1933 Kassmir ..... E04C 5/18 52/649.7
2,772,560 A * 12/1956 Neptune ..... E04C 5/167 411/108
2,861,602 A 11/1958 Thomas
3,367,084 A * 2/1968 Reiland ..... E04C 5/16 52/251
3,420,014 A * 1/1969 Courtois ..... E04B 1/4142 294/89
3,596,971 A * 8/1971 Courtois ..... B28B 23/005 294/89
3,957,087 A * 5/1976 Johnston ..... D06B 23/025 138/175
D276,308 S 11/1984 Morris, Jr.
5,152,118 A 10/1992 Lancelot
5,752,860 A 5/1998 Greaves
5,927,346 A * 7/1999 Majnaric ..... F16L 9/08 138/117

(Continued)

FOREIGN PATENT DOCUMENTS

WO WO2011031300 3/2011

*Primary Examiner* — Tyrone V Hall, Jr.

(57) ABSTRACT

A rebar construction and transportation system includes a plurality of rebar members. A jig is provided. Each of the rebar members is positioned in the jig to retain each of the rebar members in a selected pattern. A plurality of first couplers is each removably coupled to an associated one of the rebar members. Each of the first couplers may be selectively coupled to a crane to transport the rebar members. A plurality of second couplers is provided. Each of the second couplers is selectively positioned in an open position and a closed position. Each of the second couplers is positioned around an associated one of the rebar members when the second couplers are positioned in the closed position. Each of the second couplers engages the jig such the jig is retained at the selected point on the rebar members.

15 Claims, 5 Drawing Sheets

(56) References Cited

U.S. PATENT DOCUMENTS

| | | | | |
|---|---|---|---|---|
| 7,374,369 | B2 * | 5/2008 | Jakubowski | E02D 27/42 405/233 |
| 8,091,303 | B2 * | 1/2012 | Losonczi | B28B 7/364 52/306 |
| 8,375,678 | B1 * | 2/2013 | Ferrer | E04C 5/165 52/414 |
| 9,267,287 | B1 * | 2/2016 | Bongiorno | B66C 1/62 |
| 2005/0044811 | A1 * | 3/2005 | Hansort | E04B 1/41 52/704 |
| 2007/0207010 | A1 * | 9/2007 | Caspi | F16B 37/0892 411/432 |
| 2008/0072414 | A1 * | 3/2008 | Buley | B28B 23/024 29/527.1 |
| 2008/0209843 | A1 * | 9/2008 | Helms | E04C 5/163 52/677 |
| 2012/0297719 | A1 * | 11/2012 | Stevens | E04C 5/0604 52/649.8 |
| 2014/0053475 | A1 * | 2/2014 | Siqueiros | E01C 23/10 52/125.1 |

* cited by examiner

REBAR CONSTRUCTION AND TRANSPORTATION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to construction devices and more particularly pertains to a new construction device for constructing and transporting rebar structures.

BRIEF SUMMARY OF THE INVENTION

An embodiment of the disclosure meets the needs presented above by generally comprising a plurality of rebar members. A jig is provided. Each of the rebar members is positioned in the jig to retain each of the rebar members in a selected pattern. A plurality of first couplers is each removably coupled to an associated one of the rebar members. Each of the first couplers may be selectively coupled to a crane to transport the rebar members. A plurality of second couplers is provided. Each of the second couplers is selectively positioned in an open position and a closed position. Each of the second couplers is positioned around an associated one of the rebar members when the second couplers are positioned in the closed position. Each of the second couplers engages the jig such the jig is retained at the selected point on the rebar members.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
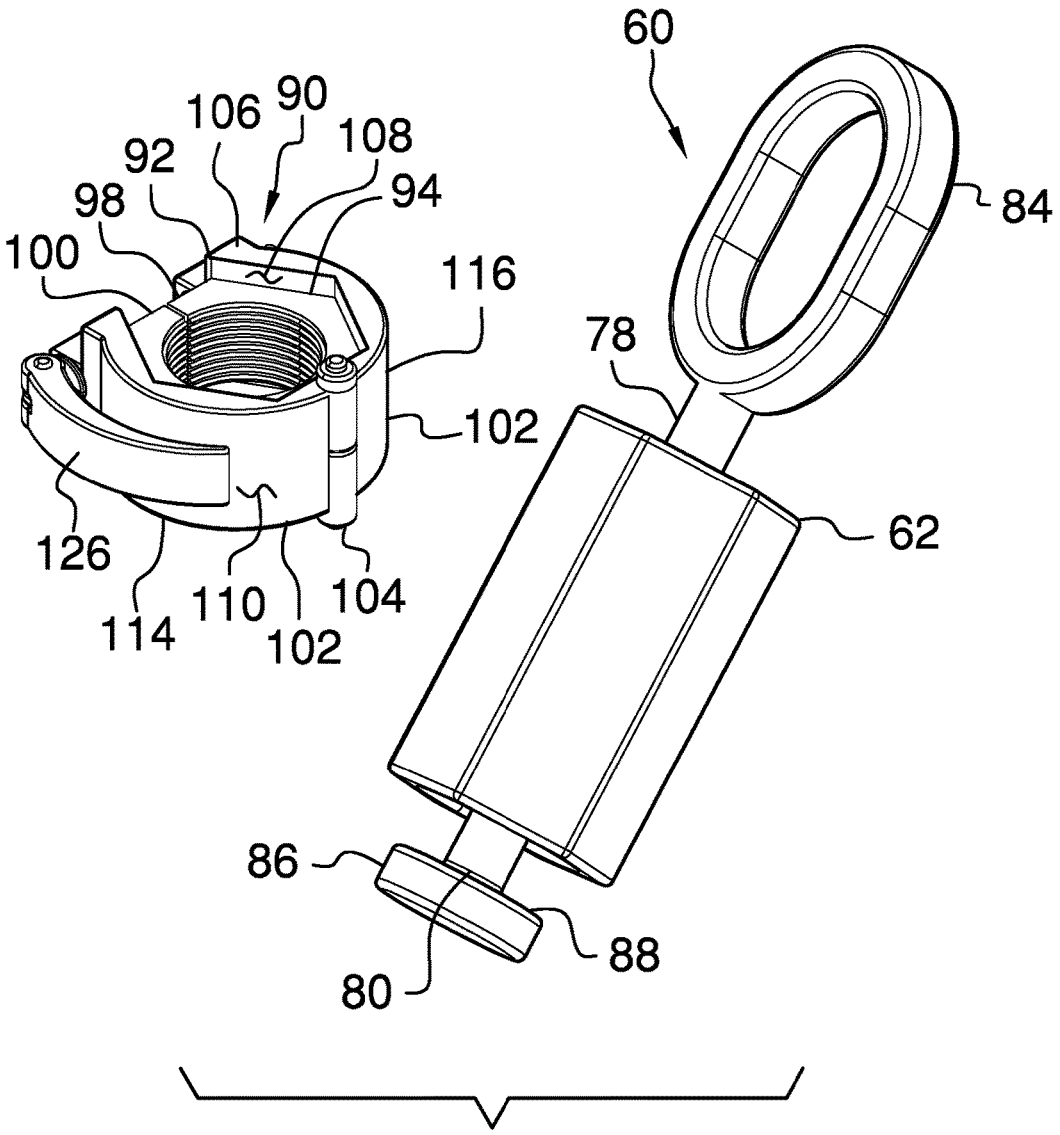
FIG. 1 is a perspective view of a first coupler and a second coupler of a rebar construction and transportation system according to an embodiment of the disclosure.
Figure 2:
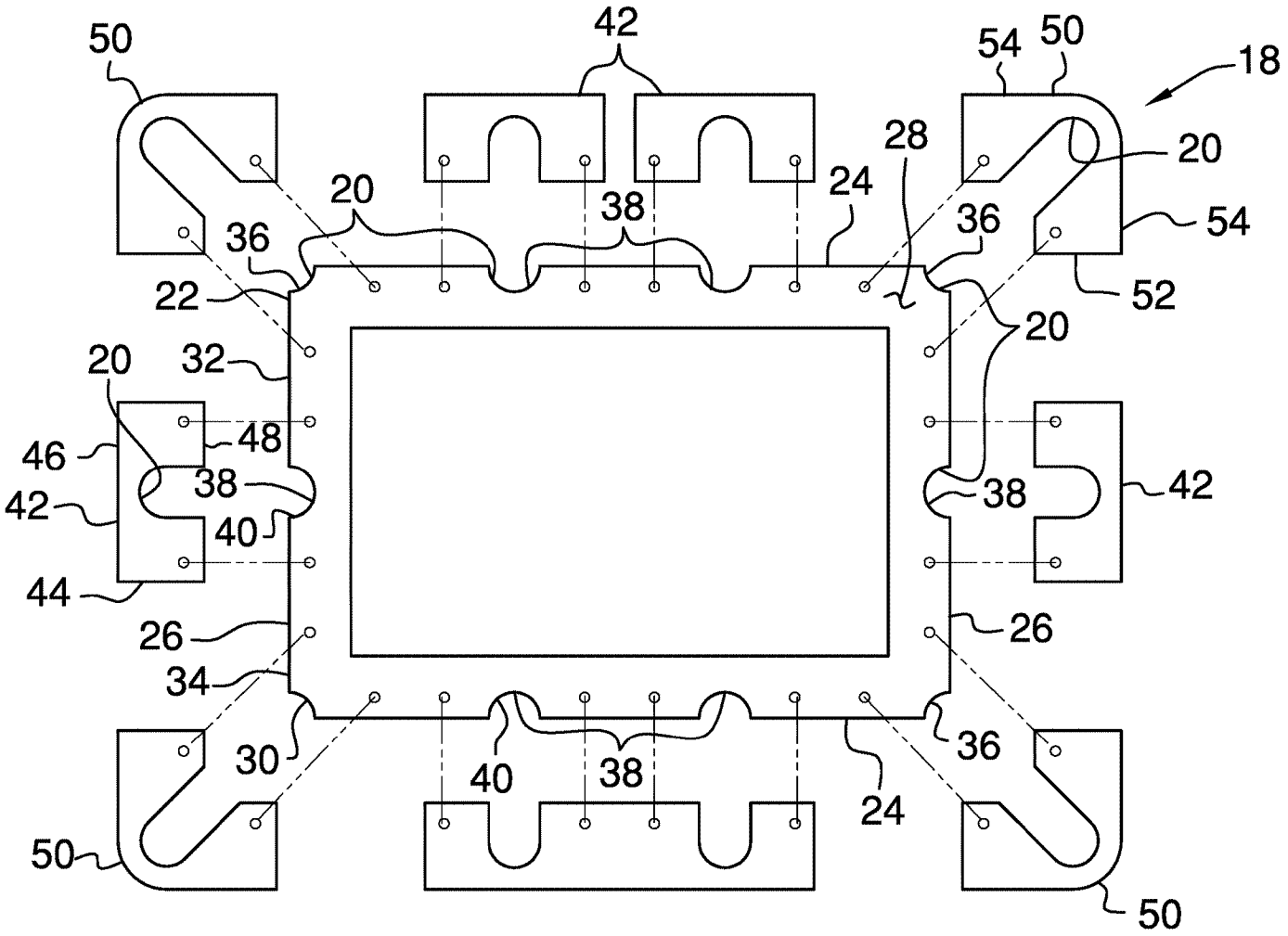
FIG. 2 is a top view of a jig of an embodiment of the disclosure.
Figure 3:
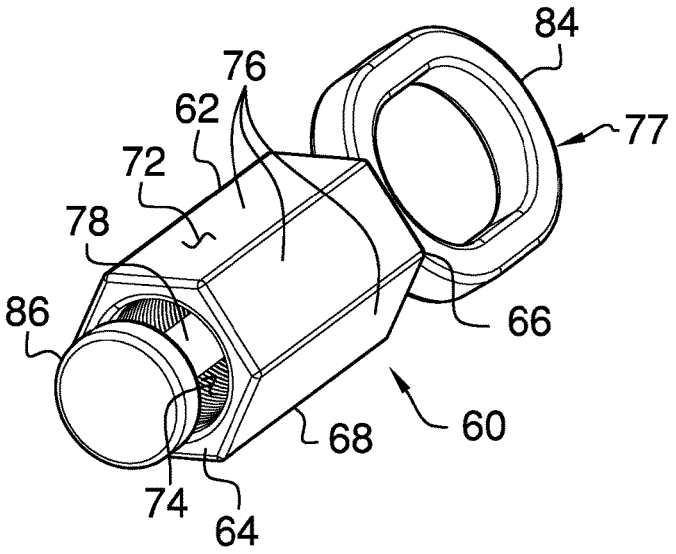
FIG. 3 is a bottom perspective view of a first coupler of an embodiment of the disclosure.
Figure 4:
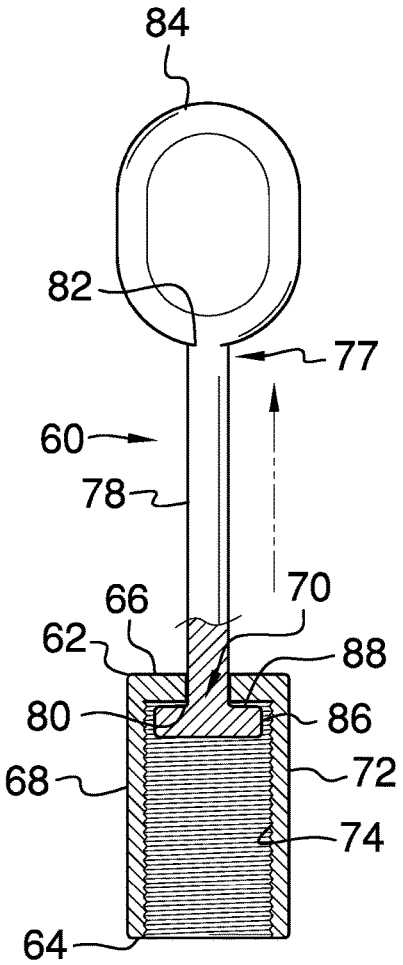
FIG. 4 is a front cut-away view of a first coupler of an embodiment of the disclosure.
Figure 5:
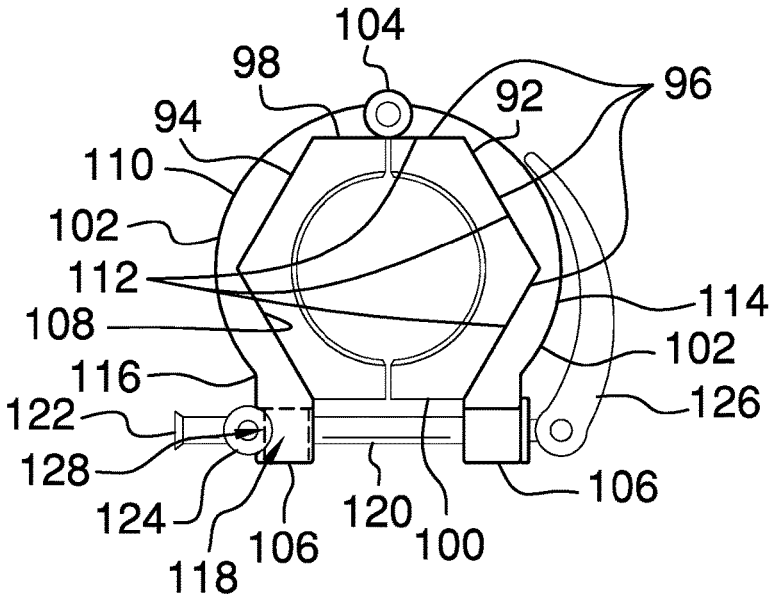
FIG. 5 is a top view of a second coupler of an embodiment of the disclosure.
Figure 6:
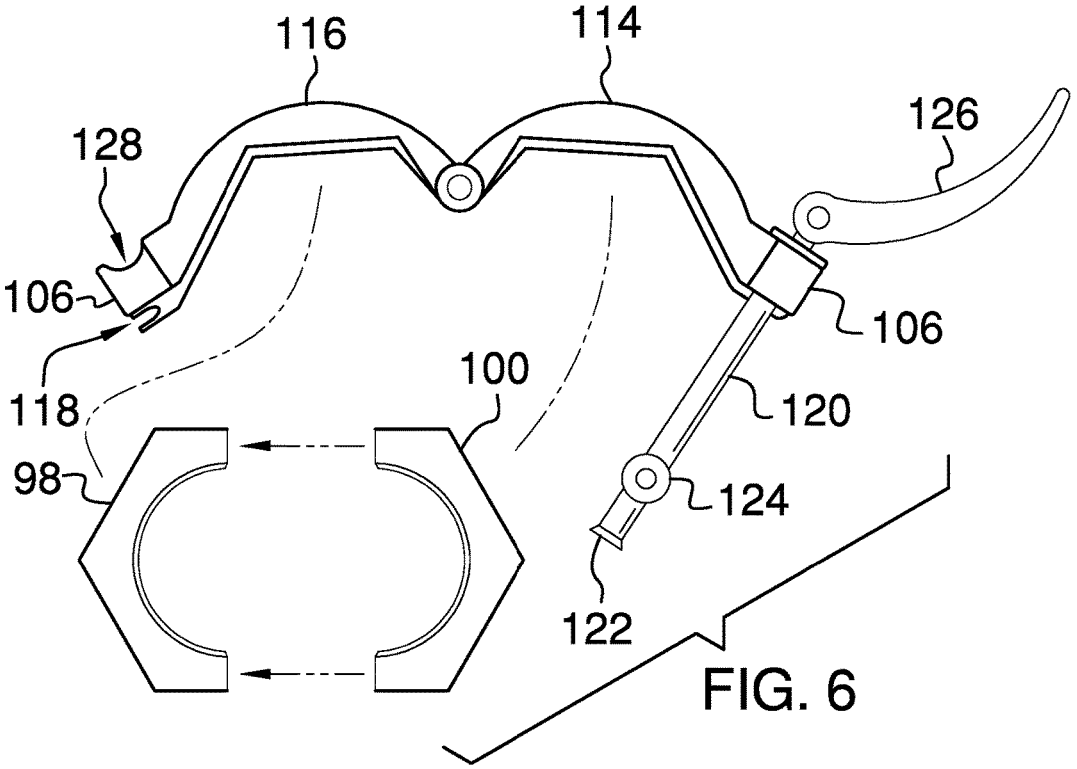
FIG. 6 is a top exploded view of a second coupler of an embodiment of the disclosure.
Figure 7:
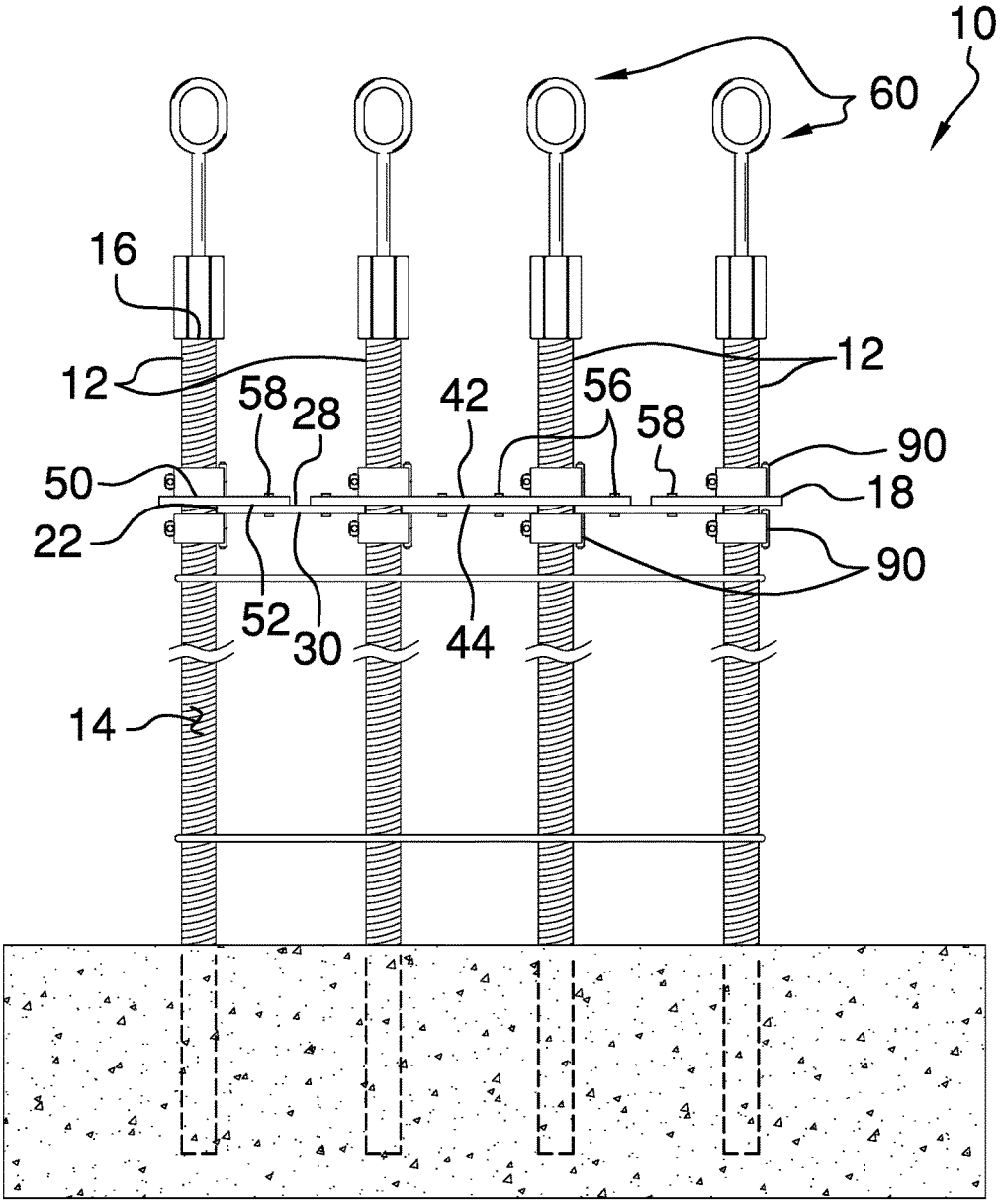
FIG. 7 is a perspective in-use view of an embodiment of the disclosure.

With reference now to the drawings, and in particular to FIGS. 1 through 7 thereof, a new construction device embodying the principles and concepts of an embodiment of the disclosure and generally designated by the reference numeral 10 will be described.

As best illustrated in FIGS. 1 through 7, the rebar construction and transportation system 10 generally comprises a plurality of rebar members 12. Each of the rebar members 12 has an outer surface 14 and the outer surface 14 corresponding to each of the rebar members 12 is threaded. Each of the rebar members 12 has a first end 16. Each of the rebar members 12 may be high strength rebar member 12 used in high rise building construction or the like.

A jig 18 is provided. The jig 18 has a plurality of grooves 20. Each of the rebar members 12 is positioned in an associated one of the grooves 20. Thus, each of the rebar members 12 is retained in a selected pattern.

The jig 18 comprises a frame 22 has a pair of first members 24 extending between each of a pair of second members 26. The second members 26 are spaced apart from each other such that the frame 22 has a rectangular shape. The frame 22 has a first surface 28, a second surface 30 and a peripheral edge 32 extending therebetween. The peripheral edge 32 has an outwardly facing side 34. Each of the grooves 20 corresponding to the frame 22 extends inwardly on the outwardly facing side 34.

The grooves 20 corresponding to the frame 22 are spaced apart from each other and are distributed around the frame 22. The plurality of grooves 20 corresponding to the frame 22 includes a set of corner grooves 36 and a set of member grooves 38. Each of the rebar members 12 is positioned in an associated one of the grooves 20 of the frame 22. Each of the grooves 20 has a bounding surface 40. The outer surface 14 of each of the rebar members 12 abuts the bounding surface 40 of the associated groove 20.

The jig 18 includes a plurality of first plates 42. Each of the first plates 42 has a primary surface 44 and an exterior edge 46. The exterior edge 46 has a first side 48 and each of the first plates 42 includes one of the grooves 20. The groove corresponding to each of the first plates 42 extends inwardly on the first side 48 on an associated one of the first plates 42. The primary surface 44 of each of the first plates 42 is positioned to abut the first surface 28 of corresponding to an associated one of the first members 24 and an associated one of the second members 26. The groove 20 corresponding to each of the first plates 42 is aligned with an associated one of the member grooves 38. Thus, the rebar members 12 corresponding to the member grooves 38 are retained in the frame 22.

The jig 18 includes a plurality of second plates 50. Each of the second plates 50 has a principle surface 52 and each of the second plates 50 has a pair of wings 54. The wings 54 corresponding to each of the second plates 50 is spaced apart from each. Thus, the groove corresponding to each of the second plates 50 is defined. The principle surface 52 of each of the second plates 50 is positioned to abut the first surface 28 of the frame 22. The groove corresponding to each of the second plates 50 is aligned with an associated one of the corner grooves 36. Thus, the rebar members 12 corresponding to the corner grooves 36 are retained in the frame 22.

A plurality of first fasteners 56 is provided. Each of the first fasteners 56 extends through an associated one of the first plates 42 and engaging the frame 22. Thus, each of the first plates 42 is removably retained on the frame 22. Each of the first fasteners 56 may comprise a nut and a bolt or the like.

A plurality of second fasteners 58 is provided. Each of the second fasteners 58 extends through an associated one of the second plates 50 and engaging the frame 22. Thus, each of the second plates 50 is removably retained on the frame 22. Each of the second fasteners 58 may comprise a nut and a bolt or the like.

A plurality of first couplers 60 is provided. Each of the first couplers 60 is removably coupled to an associated one of the rebar members 12. Each of the first couplers 60 may be selectively coupled to a crane or the like. Thus, the rebar members 12 may be transported when the rebar members 12 are positioned in the jig 18. The crane may lift the rebar members 12 onto a high rise construction site. The jig 18 orients the rebar members 12 to form a rebar structure for a vertical column or the like. Additionally, the rebar members 12 may be vertically oriented on the high rise construction site.

Each of the first couplers 60 comprises a cup 62 that has a first end 64, a second end 66 and an outer wall 68 extending therebetween. The first end 64 of the cup 62 is open and the cup 62 is substantially hollow. The second end 66 of the cup 62 has an opening 70 extending into the cup 62. The outer wall 68 has an exterior surface 72 and an inner surface 74.

The inner surface 74 is threaded. The exterior surface 72 has a plurality of intersecting sides 76. Thus, the exterior surface 72 may be engaged by a wrench. The inner surface 74 threadably engages the outer surface 14 of an associated one of the rebar members 12. The first end 16 of the associated rebar member 12 is positioned in the cup 62.

A lifting unit 77 is provided. The lifting unit 77 is slidably coupled to the cup 62. The lifting unit 77 is coupled to the crane. The, the lifting unit 77 facilitates the crane to life the rebar members 12.

The lifting unit 77 comprises a shaft 78 that has a first end 80 and a second end 82. The shaft 78 extends through the opening 70 in the cup 62. The second end 82 of the shaft 78 is exposed with respect to the cup 62. A ring 84 is coupled to the second end 82 of the shaft 78 and the crane may be coupled to the ring 84.

The lifting unit 77 includes a disk 86 that has a first surface 88. The first surface 88 of the disk 86 is coupled to the first end of the shaft 78. The disk 86 is movably positioned within the cup 62. The disk 86 abuts the second end 62 of the cup 62 when the crane lifts the lifting unit 77. Thus, the shaft 78 supports a weight of the rebar members 12.

A plurality of second couplers 90 is provided. Each of the second couplers 90 is selectively positioned in an open position and a closed position. Each of the second couplers 90 is positioned around an associated one of the rebar members 12 when the second couplers 90 are positioned in the closed position. Each of the second couplers 90 is positioned at a selected point on the associated rebar members 12. Each of the second couplers 90 engages the jig 18 such the jig 18 is retained at the selected point on the rebar members 12.

Each of the second couplers 90 comprises a nut 92. The nut 92 is threaded to threadably engages the outer surface 14 of the associated rebar member 12. The nut 92 has an outermost surface 94 and the outermost surface 94 has a plurality of intersecting sides 96. The nut 92 has a cut extending therethrough to define a first half 98 of the nut 92 and a second half 100 of the nut 92.

A pair of arms 102 is provided. Each of the arms 102 is hingedly coupled together to define a hinge point 104 and a free end 106 of each of the arms 102. Each of the arms 102 is curved between the hinge point 104 and the free end 106. The free end 106 corresponding to each of the arms 102 are spaced apart from each other. Each of the arms 102 has an inwardly facing surface 108 and an outwardly facing surface 110. The inwardly facing surface 108 has a plurality of intersecting sides 112.

The pair of arms 102 includes a first arm 114 and a second arm 116. The outermost surface 94 of the first half 98 of the nut 92 is positioned to abut the inwardly facing surface 108 of the first arm 114. The outermost surface 94 of the second half 100 of the nut 92 is positioned to abut the inwardly facing surface 108 of the second arm 116. The free end 106 of the second arm 116 has a slot 118 extending toward the hinge point 104. The outwardly facing surface 108 of the second arm 116 has a recess 128. The recess 128 is positioned adjacent to the free end of the second arm 116.

A rod 120 extends through the free end 106 of the first arm 114. The rod 120 has a distal end 122 with respect to the first arm 114. A stop 124 is coupled around the rod 120. The stop 124 is spaced from the distal end 122 of the rod 120. The slot 118 in the second arm 116 receives the rod 120 and the stop 124 is positioned in the recess 128. Thus, the stop 124 is frictionally retained on the second arm 116.

A lever 126 is hingedly coupled to the rod 120 and the lever 126 may be manipulated. The lever 126 frictionally engages the outwardly facing surface 110 of the first arm 114. The lever 126 is urged into a closing position. Thus, the stop 124 is urged toward the first arm 114 and the nut 92 is compressed around the associated rebar member 12. The lever 126 is urged into an opening 70 position. Thus, the stop 124 is urged away from the first arm 114 and the nut 92 is released from the associated rebar. The lever 126 facilitates the second couplers 90 to accommodate a variety of rebar member 12 diameters.

In use, each of the rebar members 12 is positioned in the associated grooves 20 in the frame 22. Each of the first plates 42 is positioned on the frame 22 to retain associated rebar members 12 in the associated member grooves 38. Each of the second plates 50 is positioned on the frame 22 to retain associated rebar members 12 in the associated corner grooves 36. Thus, the rebar members 12 are oriented to form a rebar structure of a vertical column. The first fasteners 56 and the second fasteners 58 couple the first plates 42 and the second plates 50 to the frame 22.

Each of the second couplers 90 is coupled around associated rebar members 12. Selected ones of the second couplers 90 are positioned on the associated rebar members 12 to abut the frame 22. Selected ones of the second couplers 90 are positioned on the associated rebar member 12 to abut the first plates 42 and the second plates 50. Thus, the jig 18 is retained at a selected point along the rebar members 12.

Each of the first couplers 60 is threadably coupled to associated rebar members 12. Moreover, each of the first couplers 60 is positioned on the first end of the associated rebar member 12. The crane is attached to the ring 84 corresponding to each of the first couplers 60. Thus, each of the rebar members 12 is lifted onto a high rise construction project. The crane positions the rebar members 12 to be vertically oriented on the high rise construction project. The crane is uncoupled from each of the first couplers 60.

Each of the first couplers 60 is removed from the rebar members 12. Concrete is poured around the rebar members 12 to define a vertical support column. Each of the second couplers 90 and the jig 18 are removed from the rebar members 12 when the concrete has dried and cured. The frame 22 may be partially submerged in the concrete. Each of the first plates 42 and the second plates 50 are removed from the frame 22 when the concrete has dried and cured.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rebar construction and transportation system comprising:

a plurality of rebar members, each of said rebar members having an outer surface, said outer surface corresponding to each of said rebar members being threaded, each of said rebar members having a first end;

a jig having a plurality of grooves, each of said rebar members being positioned in an associated one of said grooves such that each of said rebar members is retained in a selected pattern;

a plurality of first couplers, each of said first couplers being removably coupled to an associated one of said rebar members, each of said first couplers being configured to be selectively coupled to a crane thereby facilitating said rebar members to be transported when said rebar members are positioned in said jig, each of said first couplers comprises a cup having a first end, a second end and an outer wall extending therebetween, said first end being open, said cup being substantially hollow, said second end having an opening extending into said cup, said outer wall having an exterior surface and an inner surface, said inner surface being threaded, said exterior surface having a plurality of intersecting sides wherein said exterior surface is configured to be engaged by a wrench, said inner surface threadably engaging said outer surface of an associated one of said rebar members having said first end of said associated rebar member being positioned in said cup;

a plurality of second couplers, each of said second couplers being selectively positioned in an open position and a closed position, each of said second couplers being positioned around an associated one of said rebar members when said second couplers is positioned in said closed position, each of said second couplers being positioned at a selected point on said associated rebar members, each of said second couplers engaging said jig such said jig is retained at said selected point on said rebar members; and a lifting unit being slidably coupled to said cup, said lifting unit being configured to be coupled to the crane.

2. The system according to claim 1, said jig comprises a frame, a plurality of first plates and a plurality of second plates.

3. The system according to claim 2, wherein each of said first plates has a primary surface and an exterior edge, said exterior edge having a first side, each of said first plates including one of said grooves, said groove corresponding to each of said first plates extending inwardly on said first side on an associated one of said first plates.

4. The system according to claim 3, wherein:

said frame has a first surface, a pair of first members, a pair of second members and a plurality of member grooves; and said primary surface of each of said first plates being positioned to abut said first surface of corresponding to an associated one of said first members and an associated one of said second members, said groove corresponding to each of said first plates being aligned with an associated one of said member grooves such that said rebar members corresponding to said member grooves is retained in said frame.

5. The system according to claim 2, wherein each of said second plates has a principle surface, each of said second plates having a pair of wings, said wings corresponding to each of said second plates being spaced apart from each other to define said groove corresponding to each of said second plates.

6. The system according to claim 5, wherein:

said frame has a first surface and a plurality of corner groove; and said principle surface of each of said second plates being positioned to abut said first surface of said frame, said groove corresponding to each of said second plates being aligned with an associated one of said corner grooves such that said rebar members corresponding to said corner grooves is retained in said frame.

7. The system according to claim 2, further comprising:

a plurality of first fasteners, each of said fasteners extending through an associated one of said first plates and engaging said frame such that each of said first plates is removably retained on said frame; and a plurality of second fasteners, each of said second fasteners extending through an associated one of said second plates and engaging said frame such that each of said second plates is removably retained on said frame.

8. The system according to claim 1, wherein said lifting unit comprises:

a shaft having a first end and a second end, said shaft extending through said opening in said cup having said second end of said shaft being exposed;

a ring being coupled to said second end, said ring being configured to be coupled to the crane; and a disk having a first surface, said first surface of said disk being coupled to said first end of said shaft, said disk being movably positioned within said cup, said disk abutting said second end of said cup such that said shaft supports a weight of said rebar members when the crane lifts said lifting unit.

9. The system according to claim 1, wherein each of said second couplers comprises a nut being threaded such that said nut threadably engages said outer surface of said associated rebar member, said nut having an outermost surface, said outermost surface having a plurality of intersecting sides, said nut having a cut extending therethrough to define a first half of said nut and a second half of said nut.

10. The system according to claim 1, further comprising:

each of said second couplers including a nut having an outermost surface, said nut having a cut extending therethrough to define a first half of said nut and a second half of said nut; and a pair of arms, each of said arms being hingedly coupled together to define a hinge point and a free end of each of said arms, each of said arms being curved between said hinge point and said free end having said free end corresponding to each of the arms being spaced apart from each other, each of said arms having an inwardly facing surface and an outwardly facing surface, said inwardly facing surface having a plurality of intersecting sides, said pair of arms includes a first arm and a second arm, said outermost surface of said first half of said nut being positioned at abut said inwardly facing surface of said first arm, said outermost surface of said second half of said nut being positioned to abut said inwardly facing surface of said second arm, said free end of said second arm having a slot extending toward said hinge point.

11. The system according to claim 10, further comprising:

a rod extending through said free end of said first arm, said rod having a distal end with respect to said first arm; and a stop being coupled around said rod, said stop being spaced from said distal end of said rod, said slot in said second arm receiving said rod having said stop abutting said outwardly facing surface of said second arm.

12. The system according to claim 11, further comprising a lever being hingedly coupled to said rod wherein said lever is configured to be manipulated, said lever frictionally engaging said outwardly facing surface of said first arm, said lever being urged into a closing position having said stop being urged toward said first arm such that said nut is compressed around said associated rebar member, said lever being urged into an opening position having said stop being urged away from said first arm such that said nut is released from said associated rebar.

13. A rebar construction and transportation system comprising:

a plurality of rebar members;

a jig having a plurality of grooves, each of said rebar members being positioned in an associated one of said grooves such that each of said rebar members is retained in a selected pattern;

a plurality of first couplers, each of said first couplers being removably coupled to an associated one of said rebar members, each of said first couplers being configured to be selectively coupled to a crane thereby facilitating said rebar members to be transported when said rebar members are positioned in said jig;

a plurality of second couplers, each of said second couplers being selectively positioned in an open position and a closed position, each of said second couplers being positioned around an associated one of said rebar members when said second couplers is positioned in said closed position, each of said second couplers being positioned at a selected point on said associated rebar members, each of said second couplers engaging said jig such said jig is retained at said selected point on said rebar members;

a frame, a plurality of first plates and a plurality of second plates; and wherein said frame has a pair of first members extending between each of a pair of second members, said second members being spaced apart from each other such that said frame has a rectangular shape, said frame having a first surface, a second surface and a peripheral edge extending therebetween, said peripheral edge having an outwardly facing side, each of said grooves corresponding to said frame extending inwardly on said outwardly facing side, said grooves corresponding to said frame being spaced apart from each other and being distributed around said frame.

14. The system according to claim 13, wherein said plurality of grooves corresponding to said frame includes a set of corner grooves and a set of member grooves, each of said rebar members being positioned in an associated one of said grooves of said frame having an outer surface of each of said rebar members abutting said associated groove.

15. A rebar construction and transportation system comprising:

a plurality of rebar members, each of said rebar members having an outer surface, said outer surface corresponding to each of said rebar members being threaded, each of said rebar members having a first end;

a jig having a plurality of grooves, each of said rebar members being positioned in an associated one of said grooves such that each of said rebar members is retained in a selected pattern, said jig comprising:

a frame having a pair of first members extending between each of a pair of second members, said second members being spaced apart from each other such that said frame has a rectangular shape, said frame having a first surface, a second surface and a peripheral edge extending therebetween, said peripheral edge having an outwardly facing side, each of said grooves corresponding to said frame extending inwardly on said outwardly facing side, said grooves corresponding to said frame being spaced apart from each other and being distributed around said frame, said plurality of grooves corresponding to said frame including a set of corner grooves and a set of member grooves, each of said rebar members being positioned in an associated one of said grooves of said frame having said outer surface of each of said rebar members abutting said associated groove, a plurality of first plates, each of said first plates having a primary surface and an exterior edge, said exterior edge having a first side, each of said first plates including one of said grooves, said groove corresponding to each of said first plates extending inwardly on said first side on an associated one of said first plates, said primary surface of each of said first plates being positioned to abut said first surface of corresponding to an associated one of said first members and an associated one of said second members, said groove corresponding to each of said first plates being aligned with an associated one of said member grooves such that said rebar members corresponding to said member grooves is retained in said frame, and a plurality of second plates, each of said second plates having a principle surface, each of said second plates having a pair of wings, said wings corresponding to each of said second plates being spaced apart from each other to define said groove corresponding to each of said second plates, said principle surface of each of said second plates being positioned to abut said first surface of said frame, said groove corresponding to each of said second plates being aligned with an associated one of said corner grooves such that said rebar members corresponding to said corner grooves is retained in said frame, a plurality of first fasteners, each of said fasteners extending through an associated one of said first plates and engaging said frame such that each of said first plates is removably retained on said frame, and a plurality of second fasteners, each of said second fasteners extending through an associated one of said second plates and engaging said frame such that each of said second plates is removably retained on said frame;

a plurality of first couplers, each of said first couplers being removably coupled to an associated one of said rebar members, each of said first couplers being configured to be selectively coupled to a crane thereby facilitating said rebar members to be transported when said rebar members are positioned in said jig, each of said first couplers comprising:

a cup having a first end, a second end and an outer wall extending therebetween, said first end being open, said cup being substantially hollow, said second end having an opening extending into said cup, said outer wall having an exterior surface and an inner surface, said inner surface being threaded, said exterior surface having a plurality of intersecting sides wherein said exterior surface is configured to be engaged by a wrench, said inner surface threadably engaging said outer surface of an associated one of said rebar members having said first end of said associated rebar member being positioned in said cup, a lifting unit being slidably coupled to said cup, said lifting unit being configured to be coupled to the crane, said lifting unit comprising:

a shaft having a first end and a second end, said shaft extending through said opening in said cup having said second end of said shaft being exposed, a ring being coupled to said second end, said ring being configured to be coupled to the crane, and a disk having a first surface, said first surface of said disk being coupled to said first end of said shaft, said disk being movably positioned within said cup, said disk abutting said second end of said cup such that said shaft supports a weight of said rebar members when the crane lifts said lifting unit;

a plurality of second couplers, each of said second couplers being selectively positioned in an open position and a closed position, each of said second couplers being positioned around an associated one of said rebar members when said second couplers is positioned in said closed position, each of said second couplers being positioned at a selected point on said associated rebar members, each of said second couplers engaging said jig such said jig is retained at said selected point on said rebar members, each of said second couplers comprising:

a nut being threaded such that said nut threadably engages said outer surface of said associated rebar member, said nut having an outermost surface, said outermost surface having a plurality of intersecting sides, said nut having a cut extending therethrough to define a first half of said nut and a second half of said nut, a pair of arms, each of said arms being hingedly coupled together to define a hinge point and a free end of each of said arms, each of said arms being curved between said hinge point and said free end having said free end corresponding to each of said arms being spaced apart from each other, each of said arms having an inwardly facing surface and an outwardly facing surface, said inwardly facing surface having a plurality of intersecting sides, said pair of arms including a first arm and a second arm, said outermost surface of said first half of said nut being positioned at abut said inwardly facing surface of said first arm, said outermost surface of said second half of said nut being positioned to abut said inwardly facing surface of said second arm, said free end of said second arm having a slot extending toward said hinge point, a rod extending through said free end of said first arm, said rod having a distal end with respect to said first arm, a stop being coupled around said rod, said stop being spaced from said distal end of said rod, said slot in said second arm receiving said rod having said stop abutting said outwardly facing surface of said second arm, and a lever being hingedly coupled to said rod wherein said lever is configured to be manipulated, said lever frictionally engaging said outwardly facing surface of said first arm, said lever being urged into a closing position having said stop being urged toward said first arm such that said nut is compressed around said associated rebar member, said lever being urged into an opening position having said stop being urged away from said first arm such that said nut is released from said associated rebar.

* * * * *